US005454551A

United States Patent [19]

Hobday

[11] Patent Number: 5,454,551

[45] Date of Patent: Oct. 3, 1995

[54] CLAMPING DEVICE

[75] Inventor: Harold W. Hobday, Galt, Calif.

[73] Assignee: Hobday Clamp Company, Pleasanton, Calif.

[21] Appl. No.: 150,499

[22] Filed: Nov. 10, 1993

[51] Int. Cl.[6] ..... B25B 5/02

[52] U.S. Cl. ..... 269/6; 269/170

[58] Field of Search ..... 269/165–171.5, 269/147–150, 6; 81/487, 152

[56] References Cited

U.S. PATENT DOCUMENTS

| | | | |
|---|---|---|---|
| 410,815 | 9/1889 | Tarbell . | |
| 705,860 | 7/1902 | O'Brien . | |
| 886,084 | 4/1908 | Sohn et al. . | |
| 904,485 | 11/1908 | Johnson . | |
| 1,087,933 | 2/1914 | Draper . | |
| 1,529,131 | 3/1925 | Jenkins . | |
| 2,452,849 | 11/1948 | Gross . | |
| 2,718,805 | 9/1955 | Struckle . | |
| 2,815,778 | 12/1957 | Holman | 269/170 |
| 2,949,947 | 8/1960 | Story . | |
| 3,102,723 | 9/1963 | Vaudreuil . | |
| 4,220,322 | 9/1980 | Hobday . | |
| 4,436,294 | 3/1984 | Irelan . | |
| 4,712,455 | 12/1987 | Cox . | |
| 4,753,427 | 6/1988 | Lodrick, Sr. . | |
| 4,874,155 | 10/1989 | Goul . | |
| 4,893,801 | 1/1990 | Funn . | |
| 4,925,169 | 5/1990 | Lodrick, Sr. . | |
| 4,926,722 | 5/1990 | Sorensen . | |
| 4,932,638 | 6/1990 | Chen | 269/6 |
| 4,989,847 | 2/1991 | Chapman . | |
| 5,005,449 | 4/1991 | Sorensen . | |
| 5,009,134 | 4/1991 | Sorensen . | |
| 5,076,552 | 12/1991 | Challis . | |
| 5,094,131 | 3/1992 | Sorensen . | |
| 5,154,398 | 10/1992 | Mayfield | 269/6 |
| 5,161,787 | 11/1992 | Hobday . | |
| 5,169,132 | 12/1992 | Myers . | |
| 5,170,682 | 12/1992 | Sorensen . | |
| 5,197,360 | 3/1993 | Wooster . | |
| 5,217,213 | 6/1993 | Lii . | |
| 5,222,420 | 6/1993 | Sorensen . | |
| 5,265,854 | 11/1993 | Whiteford . | |

*Primary Examiner*—Robert C. Watson
*Attorney, Agent, or Firm*—Oldham, Oldham & Wilson Co.

[57] ABSTRACT

An improved bar clamp has a slide bar with a first jaw and a second jaw, the jaws set in opposing relationship along the slide bar. The first jaw may be advanced towards the second jaw by a setting mechanism that is removably attachable to the first jaw. The setting mechanism for advancing the first jaw has a hand lever and hand grip that act in concert upon manual squeezing to step-by-step advance the first jaw. The improved bar clamp also has a jaw comprising a body portion, bent along its length at an obtuse angle, which divides the body portion into an upper portion and a lower portion. A protective pad is attached to the upper portion near the end thereof on the same side of the body portion as the obtuse angle. A slot passes through the lower portion so that the body portion has a normal position on the slide bar with the side of the upper portion having the protective pad thereon forming an angle relative to the slide bar that is slightly less than a right angle, the body portion being slidable on the slide bar when the body portion is in this position. A biasing means attached to the lower portion on the opposite side of the body as the obtuse angle biases the body portion against the slide bar into this position, but the slot is sized to firmly engage the slide bar and to prevent movement of the body portion along the slide bar when the protective pad engages a workpiece in a manner that the engagement increases the angle between the side of the upper portion having the protective pad and the slide bar.

12 Claims, 7 Drawing Sheets

10
12
14
16
18
20
22
24
26
28
30
32
34
36
38
40
40a
40b
46
48
50
52
54
56
W
6
6

CLAMPING DEVICE

The present invention relates to hand tools and in particular to a bar clamp device having a setting mechanism that permits the bar clamp to be engaged with a workpiece in a one-hand manner. More particularly, the invention relates to an improved one-hand bar clamp wherein the setting mechanism is a hand grip unit that is removably attachable to the movable jaw member of the bar clamp so that the same setting mechanism may be attached to and/or detached from a plurality of bar clamp bodies. An even further aspect of the present invention device is a jaw member that is slidable along the slide bar, but which has the novel feature that the jaw is frictionally engaged with the slide bar when a workpiece is engaged between the jaws.

BACKGROUND ART

The present inventor is the inventor of U.S. Pat. No. 4,220,322, issued 2 Sep. 1980, entitled "One-Hand Operated, Ratchet-Actuated, Quick-Set C-Clamp" and U.S. Pat. No. 5,161,787, issued 10 Nov. 1992, entitled "Clamping Device." Since the issue of the inventor's first patent, several United States patents have issued for similar devices. These include:

U.S. Pat. No. 4,436,294 to Irelan (13 Mar. 1984);

U.S. Pat. No. 4,753,427 to Lodrick, Sr. (28 Jun. 1988);

U.S. Pat. No. 4,874,155 to Goul (17 Oct. 1989);

U.S. Pat. No. 4,893,801 to Flinn (16 Jan. 1990);

U.S. Pat. No. 4,925,169 to Lodrick, Sr. (15 May 1990);

U.S. Pat. No. 4,926,722 to Sorensen (22 May 1990);

U.S. Pat. No. 4,989,847 to Chapman (5 Feb. 1991);

U.S. Pat. No. 5,005,449 to Sorensen (9 Apr. 1991); and

U.S. Pat. No. 5,009,134 to Sorensen (23 Apr. 1991).

Of these, special attention should be directed to the Sorensen patents, which teach important advances in the bar clamp art. Some of the above patents deal with C-clamps; the others deal with bar clamps. The inventor's '322 patent is believed to be the first to teach a one-handed quick-grip C-clamp. The inventor's '787 patent extended the teaching to teach a C-clamp device in which the setting mechanism is separable from the clamp body such that a single setting mechanism may be utilized in conjunction with a variety of clamp bodies, even clamp bodies of various sizes.

In the present invention, the inventor extends this concept to bar clamps, where all previously known setting mechanisms must be integral with one of the jaws of the bar clamp. Even further, the inventor teaches a novel jaw member and an attachment by which a hand grip member may be attached to the movable jaw of a bar clamp.

SUMMARY OF THE INVENTION

An object of the invention is to provide a bar clamp having easy one-hand operability, but wherein the setting mechanism is detachable from the movable jaw, so that a single setting mechanism may be used with a plurality of bar clamp jaws, even bar clamp jaws of different sizes.

A further object of the present invention is to provide an opposing jaw member that is easily movable along the slide bar.

These and other objects of the invention are achieved by an improved bar clamp having a slide bar with a first jaw and a second jaw, the jaws set in opposing relationship along the slide bar. The first jaw may be advanced towards the second jaw by a setting mechanism that is removably attachable to the first jaw. The setting mechanism for advancing the first jaw has a hand lever and hand grip that act in concert upon manual squeezing to step-by-step advance the first jaw. The improved bar clamp may also utilize a jaw comprising a body portion, bent along its length at an obtuse angle, which divides the body portion into an upper portion and a lower portion. A protective pad is attached to the upper portion near the end thereof on the same side of the body portion as the obtuse angle. A slot passes through the lower portion so that the body portion has a normal position on the slide bar with the side of the upper portion having the protective pad thereon forming an angle relative to the slide bar that is slightly less than a right angle, the body portion being slidable on the slide bar when the body portion is in this position. A biasing means attached to the lower portion on the opposite side of the body as the obtuse angle biases the body portion against the slide bar into this position, but the slot is sized to firmly engage the slide bar and to prevent movement of the body portion along the slide bar when the protective pad engages a workpiece in a manner that the engagement increases the angle between the side of the upper portion having the protective pad and the slide bar.

BRIEF DESCRIPTION OF THE DRAWINGS

Understanding of the present invention will be best achieved by reference to the drawings presented herewith, wherein identical reference numerals refer to identical parts, and in which.

DETAILED DESCRIPTION OF THE DRAWINGS

Figures 1, 2, 3:
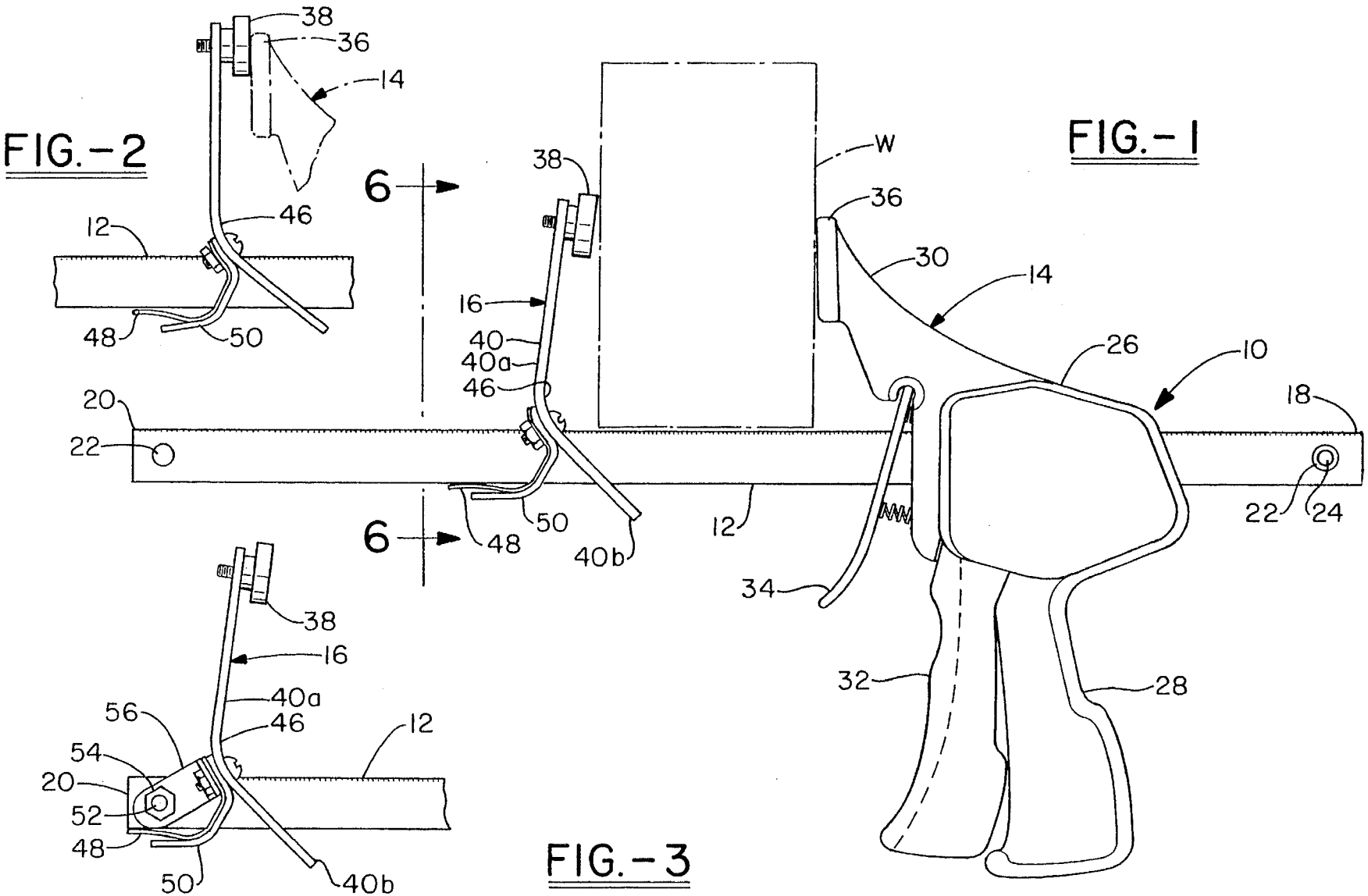
FIG. 1 shows a side elevational view of a bar clamp utilizing a first embodiment of the present invention showing the clamp just prior to the effective clamping of a workpiece, shown in ghost dot-dashed lines.
FIG. 2 shows a partial side elevational view wherein the bar clamp of FIG. 1 is in its effective clamping position.
FIG. 3 shows a partial side elevational view wherein the jaw of FIG. 1 is affixed to the slide bar.

FIG. 1 of the accompanying drawings shows a first embodiment of the present invention. The side elevational view of a quick-acting bar clamp 10 comprises a slide bar 12, a first jaw 14 positioned on the slide bar, and a second jaw 16, also positioned on the slide bar, in opposing relationship to the first jaw. The slide bar 12 is known in prior art and is very similar to that described in U.S. Pat. 4,926,722 to Sorensen ("the Sorensen '722 patent" or "the '722 patent"). The slide bar 12 has two ends, a first end 18 and a second end 20. Each of the ends 18, 20, has a transverse hole 22 passing through the slide bar 12. These holes 22 are required in the prior art devices, but are quite optional in the present invention. In FIG. 1, the hole 22 at the first end 18 has pin 24 frictionally engaged therein. The pin 24 prevents withdrawal of the slide bar 12 from a slot in the first jaw 14 when the first jaw is manually drawn away from the second jaw 16. In most embodiments of the present invention, the use of such a pin 24 is counterproductive, since the preferred embodiment of the first jaw 14 will include a setting mechanism, used for setting the first jaw into engagement with a workpiece W held between the first jaw and the second jaw 16. This setting mechanism, not illustrated in FIG. 1, must be removable from the slide bar 12 in order to provide the full operability of the bar clamp 10.

The first jaw 14 of the bar clamp 10 shown in FIG. 1 is of the same type as the "fixed jaw" taught in the Sorensen '722 patent, which is incorporated as if fully recited herein. The purpose for using the Sorensen '722 fixed jaw as the first jaw is to show how the novel second jaw 16 of the present invention 10 can be used to substitute for the "movable jaw" (as Sorenson '722 would call it) of a bar clamp available in the prior art. The slide bar 12 is slidably supported in a slot (not shown in side view) passing through a body 26 of the first jaw 14. The first jaw 14 includes the body 26 through which the slot passes, a handgrip 28 attached to the body on one side of the slot, and a jaw portion 30 attached on the other side of the slot. A trigger handle 32 is used to advance the slide bar 12 through the slot in the first jaw 14 by an internal driving lever, described in Sorensen '722. A braking lever 34 prevents movement of the first jaw 14 away from the second jaw 16. The braking lever 34 is normally engaged with the slide bar 12, and movement of the first jaw 14 away from the second jaw 16 may occur only when the braking lever is gripped by a user and pulled towards the handgrip 28. The upper end of the jaw portion 30 has a work-engaging pad 36 for engaging the workpiece W. If no workpiece W is in place, the work-engaging pad 36 would engage a similar work-engaging pad 38 on the second jaw 16.

Figure 6:
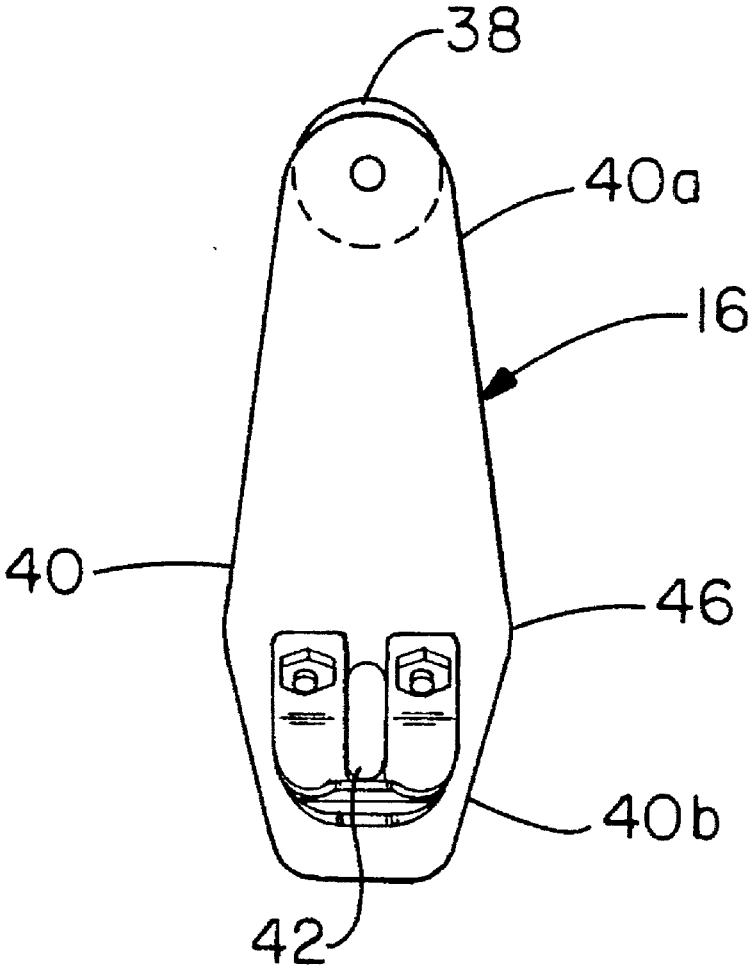
FIG. 6 shows a front elevational view of the jaw of FIG. 1 as taken along Line 6—6 thereof.

The second jaw 16 of the present invention shows a preferred embodiment of a novel jaw for a bar clamp. The second jaw 16 comprises a body portion 40, a protective pad 38, a slot 42 for passage of the slide bar 12 therethrough, and a means 44 for biasing the body portion against the slide bar. As shown in FIGS. 1–3 and 6, the body portion 40 is bent at an obtuse angle so that the obtuse angle effectively divides the body portion into an upper body portion **40*a* and a lower body portion 40*b*. The body portion 40 is a relatively narrow piece of material, preferably of metal, and most preferably a spring metal such as a spring steel. The thickness will be determined by the nature of the metal and the intended strength of the grip to be obtained, but a preferred thickness using a spring steel will be about 0.125 inches. As best shown in FIG. 6, the body portion is widest at the vertex 46 of the obtuse angle, at which the preferred embodiment will be about 1.75 inches wide. The protective pad 38, which actively engages the workpiece W when the second jaw 16 is in use, is attached to the upper portion 40*a* near the end thereof. The protective pad is on the same side of the body portion 40 as the obtuse angle. As best seen in FIG. 6, the slot 42 passes through the lower portion 40*b* below the vertex 46. In this manner, the body portion 40 has a normal position on the slide bar 12 (as shown in FIGS. 1–3) so the side of the upper portion 40*a* having the protective pad 38 thereon forms an angle slightly less than a right angle relative to the slide bar. When the upper portion 40*a* is in this slightly less than right angle relationship, the body portion 40 is relatively freely slidable on the slide bar 12. A biasing means attached to the lower portion 40*b* on the opposite side of the body portion 40 as the obtuse angle biases the body portion 40 against the slide bar 12 into this normal position, to give at least some frictional engagement of the second jaw 16 with the slide bar 12. As shown in FIG. 1–3 and 6, the biasing means is achieved in a preferred embodiment by a plate 48 of spring material supported in its biasing position by a support plate 50, both of which are attached to the lower portion 40*b*. In the embodiment taught, the slot 42 is sized so that the slide bar is slidingly engaged when the upper portion 40*a* is in the slightly less than right angle position shown in FIG. 1. However, when the protective pad 38 engages the workpiece W or the protective pad 36 of the first jaw 14, the upper portion 40*a* is pushed into a right angle relationship with the slide bar 12, as shown in FIG. 2. This change in angular relationship is effectively caused by a pivoting of the body portion about the apex 46, which is located very close to the top of the slot 42. Because the slot 42 is at an angle to the slide bar 12, the pivoting of the body portion 40 effectively narrows the height of the slot through which the slide bar passes, and the second jaw 16 is put into strong engagement with the slide bar. This pivoting action of the body portion 40 provides an additional "squeeze" to the grip of the bar clamp, which is readily observed in a "jump" of the jaws away from each other when the grip is released by depressing the braking lever 34 on the first jaw 14**.

FIG. 3 shows a slightly different embodiment of the second jaw 16 of the present invention. In this embodiment, the second jaw 16 is affixed to the slide bar 12 by a bolt 52 passing through the transverse hole 22 in the slide bar and a corresponding hole 54 in an attachment plate 56 attached to the second jaw 16 adjacent the slot 42. While such an embodiment does not permit free movement of the second jaw 16 along the slide bar 12, it still provides the enhanced gripping capacity provided by the novel second jaw in its pivoting action, as described above.

Figure 4:
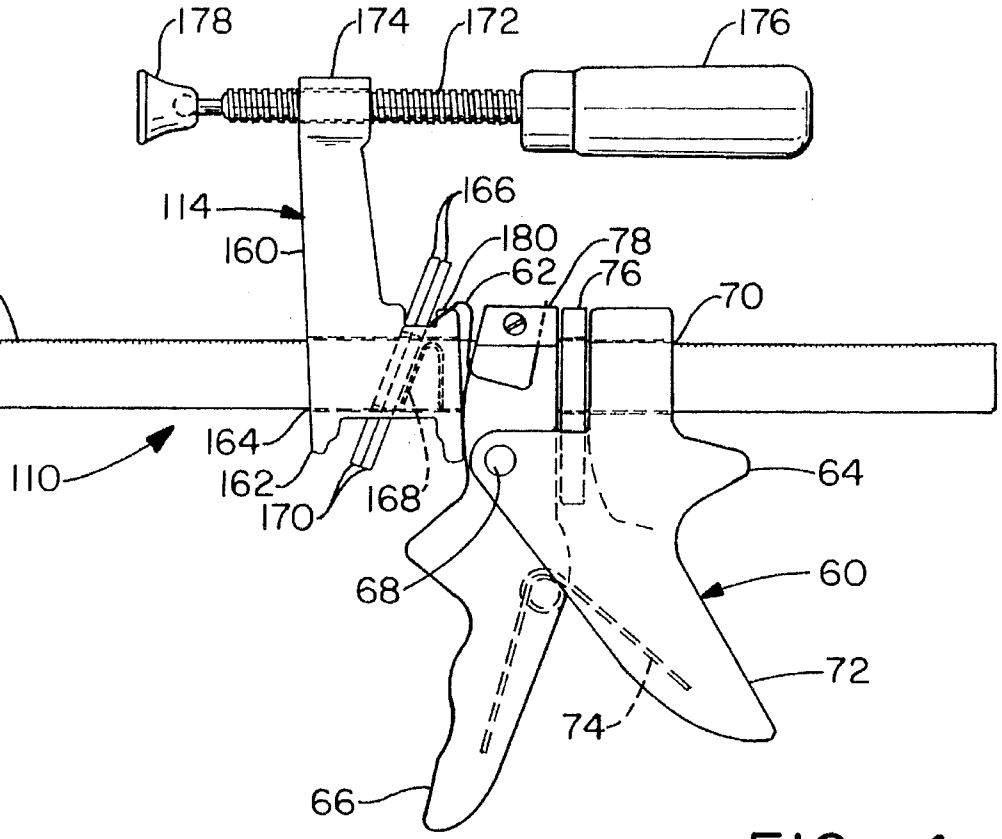
FIG. 4 shows a side elevational view of a bar clamp utilizing a second embodiment of the present invention showing the bar clamp with the setting mechanism in a first attached position relative to a jaw.
Figure 5:
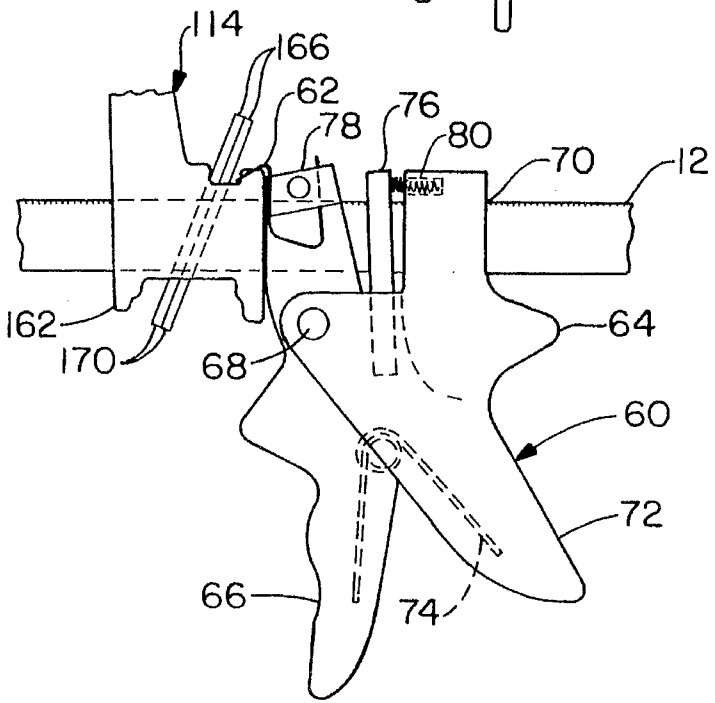
FIG. 5 shows a partial side elevational view of the bar clamp of FIG. 4, with the setting mechanism in the position where the setting mechanism is moving the jaw along the slide bar.

Other novel features of the present invention are taught in FIGS. 4 and 5. FIG. 4 shows a type of quick-acting bar clamp 110 known in the prior art, adapted by a novel removable setting mechanism 60. The bar clamp 110 has a slide bar 12, a first or movable jaw 114, and a second or fixed jaw 116. The first jaw 114 opposes the second jaw 116. In the embodiment shown in FIGS. 4 and 5, the second jaw 116 is affixed to the second end 20 of the slide bar 12 by a pin 24 passing through a transverse hole 22 in the second end. The second jaw 116 is conventional, providing only a rigid body portion 140 with a protective pad 138, and has no capacity for the enhanced gripping taught earlier in this specification.

The first jaw 114 is also known in the prior art. It has a body portion 160, with a first end 162 that straddles the slide bar 12 and has a slot 164 through which the slide bar passes. At least one braking lever 166 at the first end 162 is positioned angularly to the slide bar 12 to normally engage the slide bar and biased in that position by a biasing means 168. In FIG. 4, the biasing means 168 is shown as a spring, but other biasing means would be known and readily used by one of skill in this art. With the braking lever 166 engaging the slide bar 12 positioned as shown, the first jaw 114 is movable along the slide bar 12 toward the second jaw 116, but movement of the first jaw away from the second jaw is prevented by the braking lever. This is due to the fact that movement, such as a manual pushing, of the first jaw 114 toward the second jaw 116 momentarily disengages the braking lever 166 by pivoting the braking lever in what would be viewed in FIG. 4 as a counterclockwise direction. Although the biasing means 168 quickly reestablishes the engagement, the momentary loss of engagement permits the movement toward the second jaw 116. A manual disengagement of the braking lever 166, such as by using the lower end 170 thereof as a trigger, allows the first jaw 114 to be readily moved into engagement with a workpiece (not shown) between the jaws 114 and 116.

Unless modified by a removable setting mechanism 60 as taught in this specification, the bar clamp 110 is limited in its gripping capability to the grip provided by a theaded stem 172 passing through the second end 174 of the body portion 160. The threaded stem 172 has a handgrip 176 at one end thereof and a protective pad 178 at the other end. The bar clamp 110 grips a workpiece by moving the first jaw 114 adjacent to a workpiece through manipulation of the braking lever (as described above) and manual tightening of the protective pad 178 against the workpiece by turning the threaded stem 172, effectively moving the protective pad toward the opposing protective pad 138.

The improvement to this known device is provided by the removable setting unit 60. FIGS. 4 and 5 illustrate the action of this unit 60 in advancing the first jaw 114 into a grip of a workpiece. The setting unit 60 is very similar to the setting unit taught in the inventor's '787 patent, issued 10 Nov. 1992, which is incorporated by reference as if fully recited herein. The setting unit 60 is removably attached to the first jaw by a mounting means 62. In the example shown in FIGS. 4 and 5, the mounting means 62 is a bail wire that is attached to each side of the setting unit 60 and which passes around a raised portion 180 of the lower end 162 of the first jaw 114. Other mounting means 62 are known and can be utilized, depending upon whether the mounting means needs to be adapted to fit an already existing jaw, such as first jaw 114, or whether the first jaw and the removable setting unit are designed together, in which case a mounting means such as the clevis-shaped lever of the inventor's '787 patent may be used.

Attention is now directed to FIGS. 4 and 5, where the setting unit 60 is best explained by reference to the operation thereof. The setting unit 60 comprises a body 64, pivotably attached to a trigger 66 by a pin 68. The body 64 has a slot 70 therethrough at its upper end to accomodate the slide bar 12, and, at its lower end, provides a handle 72. A biasing means 74, shown as a spring in FIG. 4, internal to the handle 72 and the trigger 66 keeps the handle and trigger normally biased away from each other. A driving lever 76, positioned on the slide bar 12 between the body 64 and the upper portion 78 of the trigger 66, that is, the portion of the trigger located above the pin 68, is biased by a biasing means 80. The mounting means 62 is attached to the upper portion 78 so that the upper portion 78 is positioned in adjacent contact to the first jaw 114.

As shown in FIGS. 4 and 5, the driving lever 76 is normally held (as in FIG. 4) in a disengaged position from the slide bar 12, but when the trigger 66 is gripped and depressed towards the handle 72, the biasing means 80 pivots the driving lever 76 counterclockwise into engagement with the slide bar (as in FIG. 5), preventing movement of the setting unit 60 on the slide bar towards the right in FIGS. 4 and 5. In other words, movement of the setting unit 60 towards the first jaw 114 is permitted; movement away is prevented. The very act of depressing the trigger 66 towards the handle 72 moves the upper portion 78 towards the first jaw 114. Since the driving lever 76 has been biased outwardly into engagement by the same gripping action, the forward movement of the upper portion 78 moves the first jaw 114 towards the second jaw 116. Because the first jaw 114 and the setting unit 60 are connected by the mounting means 62, the relaxing of the grip on the trigger 66 walks the setting unit along the slide bar 12, since the driving lever 76 disengages while the braking lever 166 on the first jaw reengages. By repetitive gripping and relaxing, the setting unit advances the first jaw into contact with the workpiece.

Figure 7:
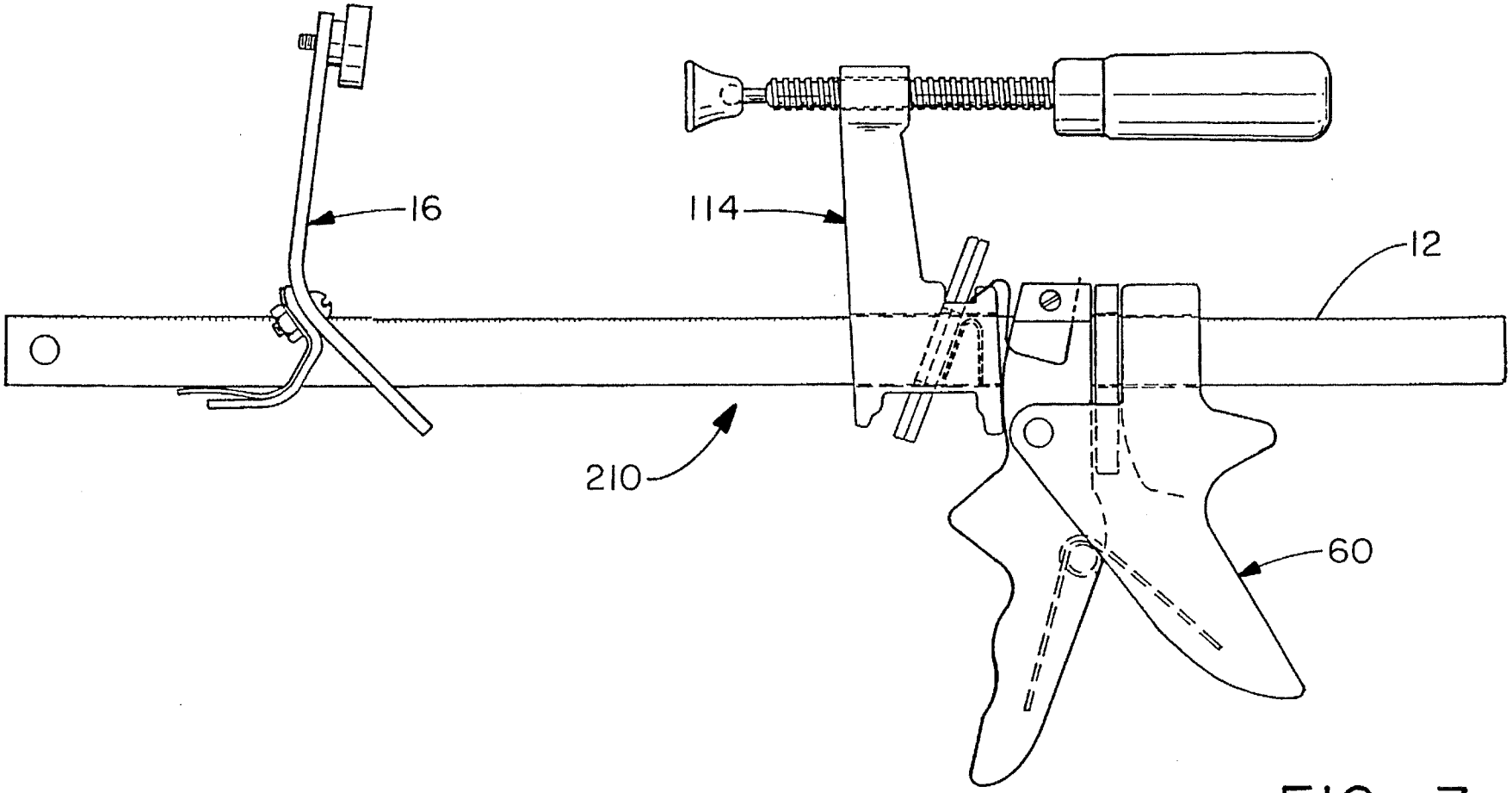
FIG. 7 shows a side elevational view of a bar clamp utilizing a third embodiment of the present invention showing the bar clamp with the novel setting mechanism and the novel second jaw.

A further embodiment 210 of the present invention is presented in FIG. 7, which shows an elevational view of a device using the known first jaw 114 and the known slide bar 12, but adding the novel second jaw 16 and the novel setting unit 60.

Figure 8:
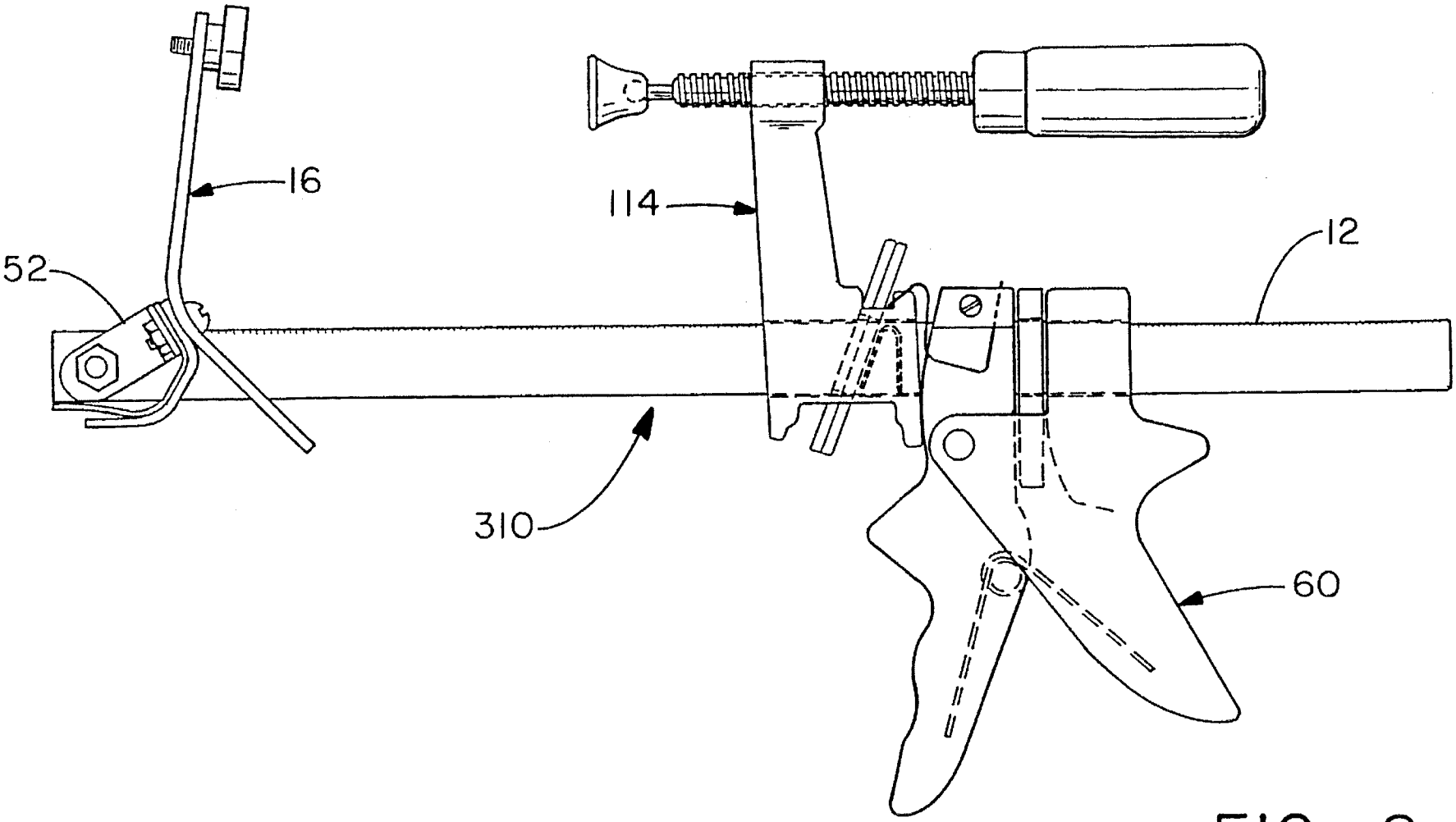
FIG. 8 shows a side elevational view of a bar clamp utilizing a fourth embodiment of the present invention showing the bar clamp with the novel setting mechanism and a variation on the novel second jaw.

A further embodiment 310 of the present invention is presented in FIG. 8, which shows an elevational view of a device using the known first jaw 114 and the known slide bar 12, but adding the variation on novel second jaw 16 taught in FIG. 3 above and the novel setting unit 60.

Figure 9:
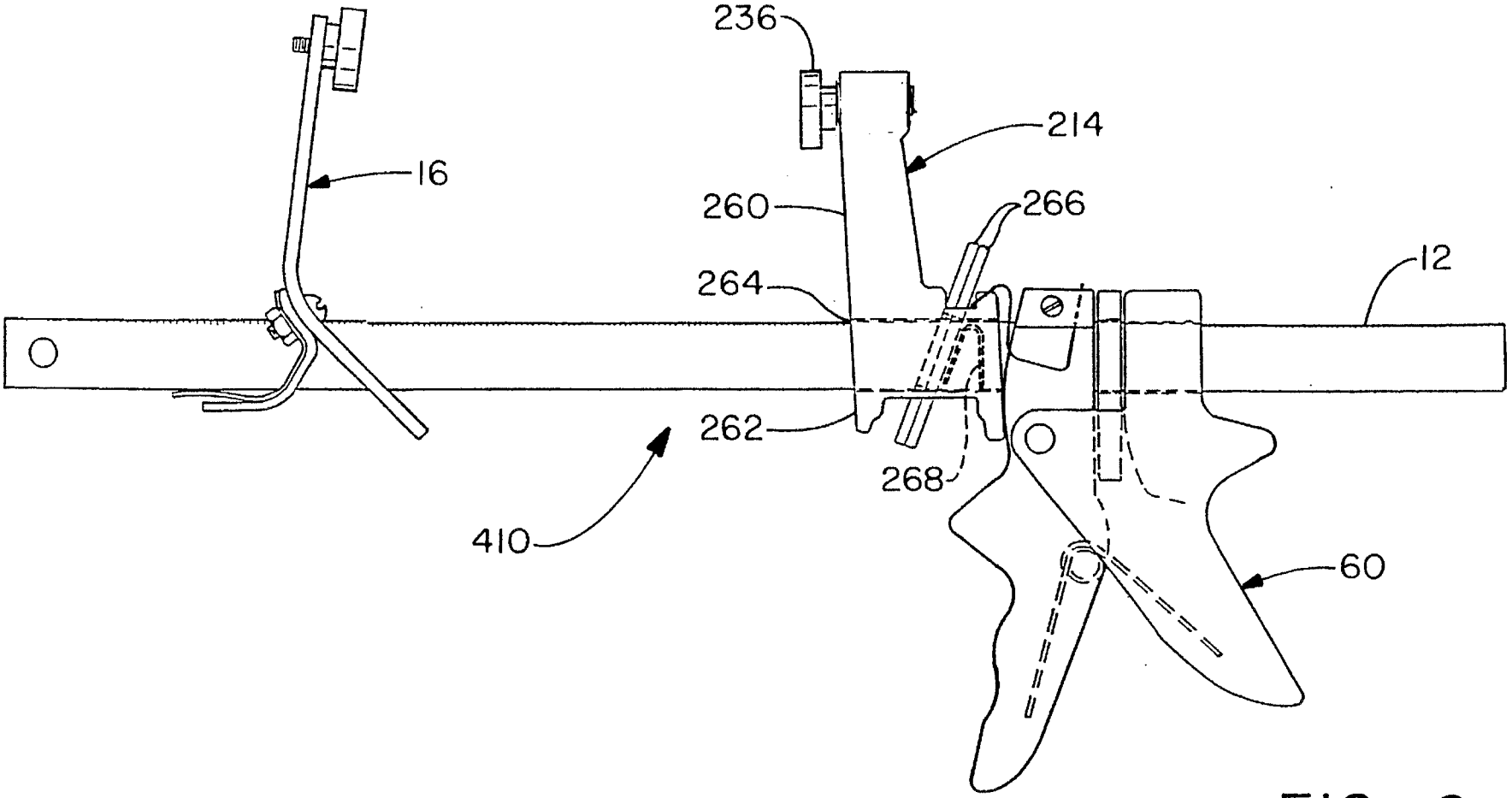
FIG. 9 shows a side elevational view of a bar clamp utilizing a fifth embodiment of the present invention showing the bar clamp with the novel setting mechanism and novel first and second jaws.

A yet further embodiment 410 of the present invention is presented in FIG. 9, which shows an elevational view of a device using the known slide bar 12, but using a novel first jaw 214, the novel second jaw 16 and the novel setting unit 60. In this embodiment, the first jaw 214 has a body portion 260, with a first end 262 that straddles the slide bar 12 and has a slot 264 through which the slide bar passes. At least one braking lever 266 at the first end 262 is positioned angularly to the slide bar 12 to normally engage the slide bar and biased in that position by a biasing means 268. In FIG. 4, the biasing means 268 is shown as a spring, but other biasing means would be known and readily used by one of skill in this art. With the braking lever 266 engaging the slide bar 12 positioned as shown, the first jaw 214 is movable along the slide bar 12 toward the second jaw 16, but movement of the first jaw away from the second jaw is prevented by the braking lever. This is due to the fact that movement, such as a manual pushing, of the first jaw 214 toward the second jaw 16 momentarily disengages the braking lever 266 by pivoting the braking lever in what would be viewed in FIG. 9 as a counterclockwise direction. Although the biasing means 168 quickly reestablishes the engagement, the momentary loss of engagement permits the movement toward the second jaw 116. A manual disengagement of the braking lever 266, such as by using the lower end 270 thereof as a trigger, allows the first jaw 214 to be readily moved into engagement with a workpiece (not shown) between the first and second jaws, 214 and 16. Because of the incorporation of the removable setting mechanism 60, the bar clamp 410 does not need the threaded stem 172 taught with regard to first jaw 114 above, so a simple protective pad 236 is used instead.

Figure 10:
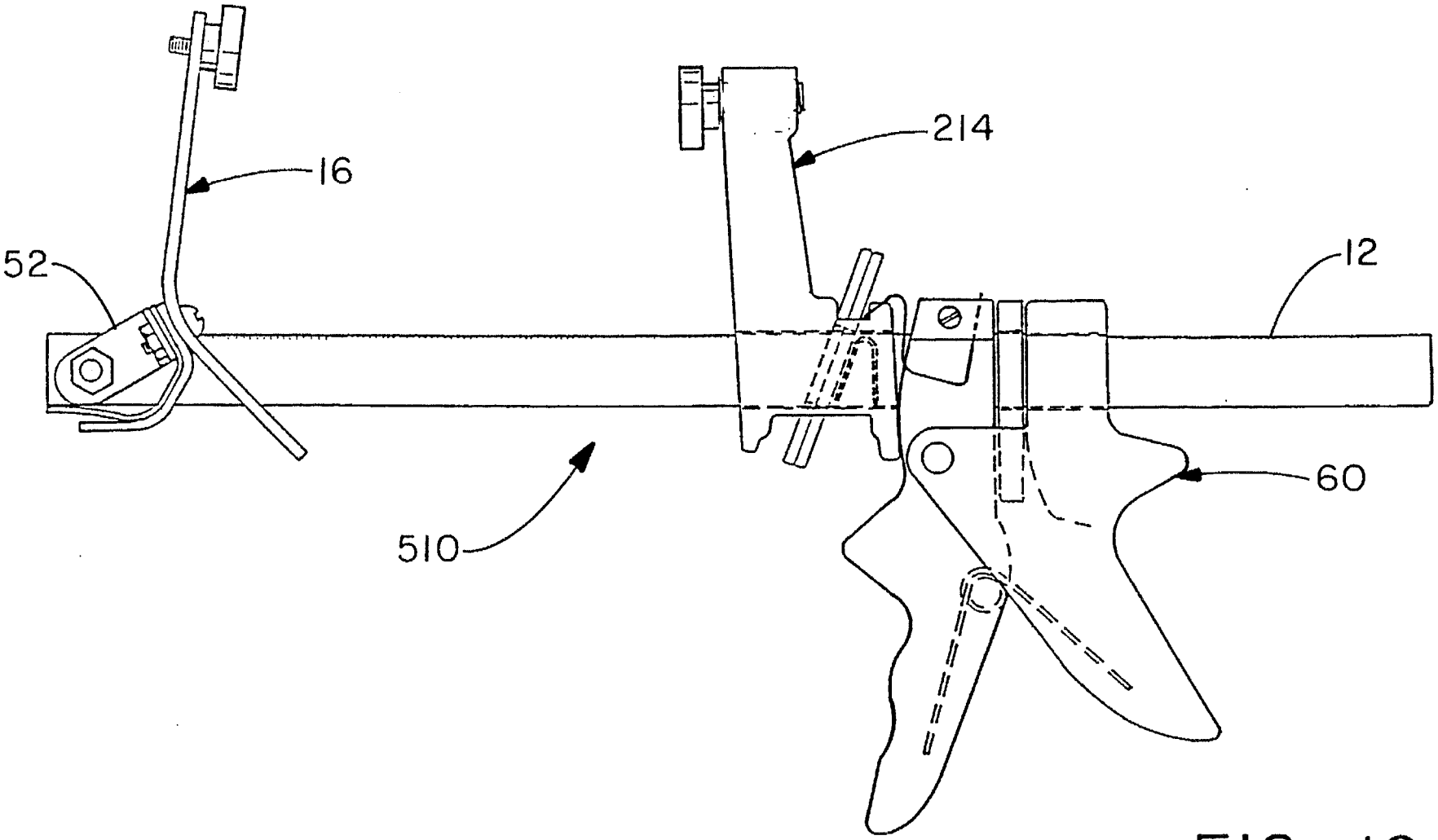
FIG. 10 shows a side elevational view of a bar clamp utilizing a sixth embodiment of the present invention showing the bar clamp with the novel setting mechanism, the novel first jaw and a variation on the novel second jaw.

A final embodiment 510 of the present invention is presented in FIG. 10, which shows an elevational view of a device using the known slide bar 12, but using a novel first jaw 214 taught in association with FIG. 9, the variation on the novel second jaw 16 taught in FIG. 3 and the novel setting unit 60.

While in accordance with the patent statutes, the best mode and preferred embodiment of the invention have been described, it is to be understood that the invention is not limited thereto, but rather is to be measured by the scope and spirit of the appended claims.

What is claimed is:

1. A quick-acting bar clamp comprising:

a first jaw;

a second jaw for opposing the first jaw;

a slide bar, said second jaw being positioned along the slide bar, the slide bar being movable to bring the second jaw toward and away from the first jaw;

support means for supporting the slide bar, the first jaw being connected to the support means;

one-way drive means for releasably engaging and, when engaged, for advancing the slide bar and the second jaw, the second jaw being subject to advancement toward the first jaw when the one-way drive means is actuated;

the one-way drive means having a driving lever, and a braking lever normally engaging the slide bar, the braking lever when engaging the slide bar preventing motion of the second jaw away from the first jaw, and when disengaging the slide bar allowing advancement of the second jaw away from the first jaw, the braking lever having an engaging portion extending outwardly from the support means;

a trigger handle pivotably mounted to the support means rearwardly of the braking lever and contacting the driving lever, the engaged driving lever moving the slide bar and the second jaw toward the first jaw, the support means including a handgrip, a trigger-type relationship existing between the trigger handle and the handgrip, the bar clamp being holdable at said handgrip, the braking lever and the trigger handle being selectively operable by the same hand in such a manner that one of the index and middle fingers is positioned on the engaging portion of the braking lever to actuate the braking lever, while the other fingers encircle and contain the trigger handle and the handgrip; and wherein the second law comprises:

a body portion, bent along the length thereof at an obtuse angle on the side facing the first jaw, said obtuse angle dividing the body portion into an upper portion and a lower portion;

a protective pad attached to the upper portion near the end thereof on the side facing the first jaw;

a slot passing through the lower portion so that the body portion has a normal position on the slide bar with the side facing the first jaw forming an angle relative to the slide bar that is slightly less than a right angle, said body portion being slidable on the slide bar when the body portion is in said normal position;

a biasing means attached to the lower portion on the opposite side of the body portion from the obtuse angle to bias the body portion against the slide bar into the normal position;

said slot sized to firmly engage the slide bar and to prevent movement of the body portion along the slide bar when the first and second jaws engage a workpiece, said engagement increasing the angle between the side facing the first jaw and the slide bar.

2. The quick-acting bar clamp of claim 1 wherein the biasing means attached to the lower portion of the body portion comprises a plate of spring material supported in a biasing position against the slide bar by an underlying support plate.

3. The quick-acting bar clamp of claim 1 wherein the second jaw further comprises a plate with an aperture therethrough for affixing the second jaw, aligning said aperture with a corresponding aperture in the slide bar and passing a pin through the apertures.

4. A quick-acting bar clamp comprising:

a slide bar having a first end and a second end;

a first jaw positioned on said slide bar;

a second jaw positioned on said slide bar in opposing relationship to said first jaw;

said first jaw having a normally-engaged braking lever disposed thereon, said braking lever allowing the first jaw to move along the slide bar toward the second jaw when the braking lever is disengaged from said slide bar, but preventing the first jaw from moving away from the second jaw when the braking lever is engaged with the slide bar; and a setting unit for advancing the first jaw towards the second jaw, said setting unit removably mountable to said first jaw such that the first jaw is between the second jaw and the setting unit on the slide bar.

5. A jaw for a bar clamp having a slide bar, said jaw comprising:

a body portion, bent along the length thereof at an obtuse angle on a first side thereof, said obtuse angle dividing the body portion into an upper portion and a lower portion;

a protective pad attached to the upper portion near the end thereof on the same side of the body portion as the obtuse angle;

a slot passing through the lower portion so that the body portion has a normal position on the slide bar with the side of the upper portion having the protective pad theron forming an angle relative to the slide bar that is slightly less than a right angle, said body portion being slidable on the slide bar when the body portion is in said normal position;

a biasing means attached to the lower portion on the opposite side of the body portion from the obtuse angle to bias the body portion against the slide bar into the normal position;

said slot sized to firmly engage the slide bar and to prevent movement of the body portion along the slide bar when the protective pad engages a workpiece, said engagement increasing the angle between the side of the upper portion having the protective pad and the slide bar.

6. An improvement for a quick-acting bar clamp having a first jaw; a second jaw for opposing the first jaw, said first jaw having a threaded stem therethrough to engage said second jaw; and a slide bar, said second jaw being positioned along the slide bar, said first jaw being movable on the slide bar toward and away from the second jaw; said first jaw having a braking lever normally engaging the slide bar, the braking lever when engaging the slide bar preventing motion of the first jaw away from the second jaw, and when disengaging said slide bar allowing movement of the first jaw toward or away from the second jaw; wherein the improvement comprises:

a setting unit for pushing the first jaw towards the second jaw, said setting unit removably mountable to the first jaw such that the first jaw is between the second jaw and the setting unit on the slide bar.

7. The improvement of claim 6 wherein the second jaw comprises:

a body portion, bent along the length thereof at an obtuse angle on a first side thereof, said obtuse angle dividing the body portion into an upper portion and a lower portion;

a protective pad attached to the upper portion near the end thereof on the same side of the body portion as the obtuse angle;

a slot passing through the lower portion so that the body portion has a normal position on the slide bar with the side of the upper portion having the protective pad theron forming an angle relative to the slide bar that is slightly less than a right angle, said body portion being slidable on the slide bar when the body portion is in said normal position;

a biasing means attached to the lower portion on the opposite side of the body as the obtuse angle to bias the body portion against the slide bar into the normal position;

said slot sized to firmly engage the slide bar and to prevent movement of the body portion along the slide bar when the protective pad engages a workpiece, said engagement increasing the angle between the side of the upper portion having the protective pad and the slide bar.

8. The improvement of claim 6 wherein the second jaw further comprises a plate with an aperture therethrough for affixing the second jaw, aligning said aperture with a corresponding aperture in the slide bar and passing a pin through the apertures.

9. An improvement for a quick-acting bar clamp having a first jaw; a second jaw for opposing the first jaw; and a slide bar, said second jaw being positioned along the slide bar, said first jaw being movable on the slide bar toward and away from the second jaw; said first jaw having a braking lever normally engaging the slide bar, the braking lever when engaging the slide bar preventing motion of the first jaw away from the second jaw, and when disengaging said slide bar allowing movement of the first jaw toward or away from the second jaw; wherein the improvement comprises:

a setting unit for pushing the first jaw towards the second jaw, said setting unit removably mountable to the first jaw such that the first jaw is between the second jaw and the setting unit on the slide bar.

10. The improvement of claim 9 wherein the second jaw comprises:

a body portion, bent along the length thereof at an obtuse angle on a first side thereof, said obtuse angle dividing the body portion into an upper portion and a lower portion;

a protective pad attached to the upper portion near the end thereof on the same side of the body portion as the obtuse angle;

a slot passing through the lower portion so that the body portion has a normal position on the slide bar with the side of the upper portion having the protective pad theron forming an angle relative to the slide bar that is slightly less than a right angle, said body portion being slidable on the slide bar when the body portion is in said normal position;

a biasing means attached to the lower portion on the opposite side of the body as the obtuse angle to bias the body portion against the slide bar into the normal position;

said slot sized to firmly engage the slide bar and to prevent movement of the body portion along the slide bar when the protective pad engages a workpiece, said engagement increasing the angle between the side of the upper portion having the protective pad and the slide bar.

11. The improvement of claim 9 wherein the second jaw further comprises a plate with an aperture therethrough for affixing the second jaw, aligning said aperture with a corresponding aperture in the slide bar and passing a pin through the apertures.

12. In a bar clamp having a slide bar and two jaws mounted thereon, at least one of which jaws is movable toward and away from the other, at least one of the jaws comprising a body portion formed of spring metal bent along the length thereof at an obtuse angle on the side thereof facing the other jaw, said obtuse angle dividing the body portion into an upper portion and a lower portion;

a slot passing through said lower portion so that the body portion has a normal position on the slide bar with the side facing the other jaw forming an angle relative to the slide bar that is slightly less than a right angle;

biasing means attached to said lower portion on the opposite side of the body portion from said obtuse angle to bias the body portion against the slide bar into its normal position;

said slot sized to firmly engage the slide bar when the jaws engage a workpiece, said engagement increasing the angle between the side of the body portion facing the other jaw and the slide bar.

* * * * *